US005803778A

United States Patent [19]

Hardy

[11] Patent Number: 5,803,778

[45] Date of Patent: Sep. 8, 1998

[54] METHODS AND APPARATUS FOR HANDLING WASTE

[76] Inventor: David E. Hardy, 2255 Dallin St., Salt Lake City, Utah 84109

[21] Appl. No.: 781,725

[22] Filed: Jan. 10, 1997

[51] Int. Cl.[6] ..... B63B 22/00

[52] U.S. Cl. ..... 441/1; 4/484; 441/136

[58] Field of Search ..... 43/56; 114/270, 114/264, 263, 343; 441/1, 21, 23, 27, 136; 4/484

[56] References Cited

U.S. PATENT DOCUMENTS 3,416,164 12/1968 Ekrut ..... 4/484

3,428,967 2/1969 Hughes ..... 4/484

4,312,085 1/1982 Potter ..... 4/484

*Primary Examiner*—Ed L. Swinehart

*Attorney, Agent, or Firm*—Workman, Nydegger & Seeley

[57] ABSTRACT

The present invention is directed to an apparatus for containers of human waste. The apparatus has a floating receiving station with receiving apertures projecting from the receiving station to receive containers of human waste which have been stored on a boat. As the boat approaches the receiving station, the waste may be placed within the receiving aperture and thereby prevent the pollution of water.

1 Claim, 6 Drawing Sheets

METHODS AND APPARATUS FOR HANDLING WASTE

BACKGROUND OF THE INVENTION

The Field of the Invention

The critical challenge facing heavily used rivers and lakes is finding a viable solution for the collection and disposal of human waste—that people will use. Any solution that is not extremely "user friendly" will ultimately fail due to the fact that large bodies of water comprise vast isolated areas making enforcement of regulations or procedures that are a "hassle" virtually impossible. Users will simply continue to do what is easiest—defecate in the sand or in the water—unless the alternative is convenient enough to enable the user's underlying desire to help preserve the body of water to prevail over the impulse to do what is easiest at the moment.

Attempted solutions to this problem have included the mandatory use of marine toilets. One problem with marine toilets is that they must be dumped and cleaned out nearly every day—a task that is both time consuming and unpleasant in the extreme. Due to their oftentimes complex arrangement of water and chemical chambers, portable/marine toilets can be difficult for children to use, and therefore messy. Most are made primarily for use on a boat, and therefore can only be used in cramped, hot, airless areas. Many boats don't even have a private area for a marine toilet. Even house-boat users would rather use the natural facilities in privacy than fill up and pump out their toilets. If the proposed solution to the problem is simply to require all boaters to carry portable or marine toilets on their boats and to construct additional dumping stations so the trip isn't quite so long each day to dump and clean out the toilet, very little will change. Human nature won't allow the solution work. People will continue to do what is easiest, and effective enforcement throughout the marine areas remains impossible.

Again, because of the number and remote nature of many shoreline campsites, the ability to effectively enforce any regulation is limited at best. Many campsites do not have a sandy area that is above the high-water line, and there is no guarantee that even if there a were a sandy area above the high-water line it would be accessible and private enough to cause people to use it. Waste minimally buried in higher, sandy ground will, over time, leach and migrate to the lower campsites and into the lake with rain run-off. With the large and ever-increasing number of people using the shoreline campsites, on-site disposal of human waste is not a viable long-term solution even if placement could be enforced.

SUMMARY AND OBJECTS OF THE INVENTION

It is therefore, one object of the present invention to provide methods and apparatus which are easy to use and ensure the user minimal contact with human waste. The invention provides the user maximum privacy and immediate access. Disposal is clean, close and convenient. The invention provides a simple system for daily collection of the waste and removal from the Lake. The invention creates no additional expense for the Government. Above all, the invention allows strong public and user support so that implementation and enforcement will primarily come from the users themselves.

The current invention provides a molded container from heavy-duty plastic with an attached seat and liner bags to be given to each boat putting-in at the marina. The liner bags are heavy-duty (akin to trash compactor bags) and decomposable. Each boat would be required to rent a unit as it puts-in. When the boat pulls-out, half the rental price is returned when the unit is returned.

The invention can be located anywhere at a campsite that provides the best access and privacy, or it can be used in a boat like a marine toilet. When the bag becomes full enough, it is tied closed and a new bag is put into the ammo can. Full bags are taken by boat and deposited in one of the collection containers to be discussed later herein. These collection containers may be located at regular intervals along the main channels or at convenient points on the body of water.

Collection points would be located in the water at approximately five-mile intervals along a channel, in major bays and at the head of major inlets. These collection points would consist of floating cylinders (roughly 5' in diameter and 10' in height) constructed of heavy-duty plastic with two depository arms emerging from the top and a removable inner container. The collection containers would be anchored to the bottom in the water, like the marker buoys, so that a boat can easily pull up to it and deposit a full bag into one of the depository arms without scraping the boat. The bags would fall into the inner container. As the bottom portion of the container would be submerged, the bags and their contents would be maintained at a cool temperature until collection.

Collection barges would be used to cruise the channel daily and pick up the waste bags deposited at the collection points. The barge would have a small crane and winch that would lift the inner container containing the bags out of the floating shell and replace it with an empty inner container.

Ultimate disposal of the waste would be contracted through local sources. Ultimately, if it proved feasible, a waste treatment facility could be constructed and operated near the body of water uniquely for waste from the marine areas.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawing depict only a typical embodiment of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
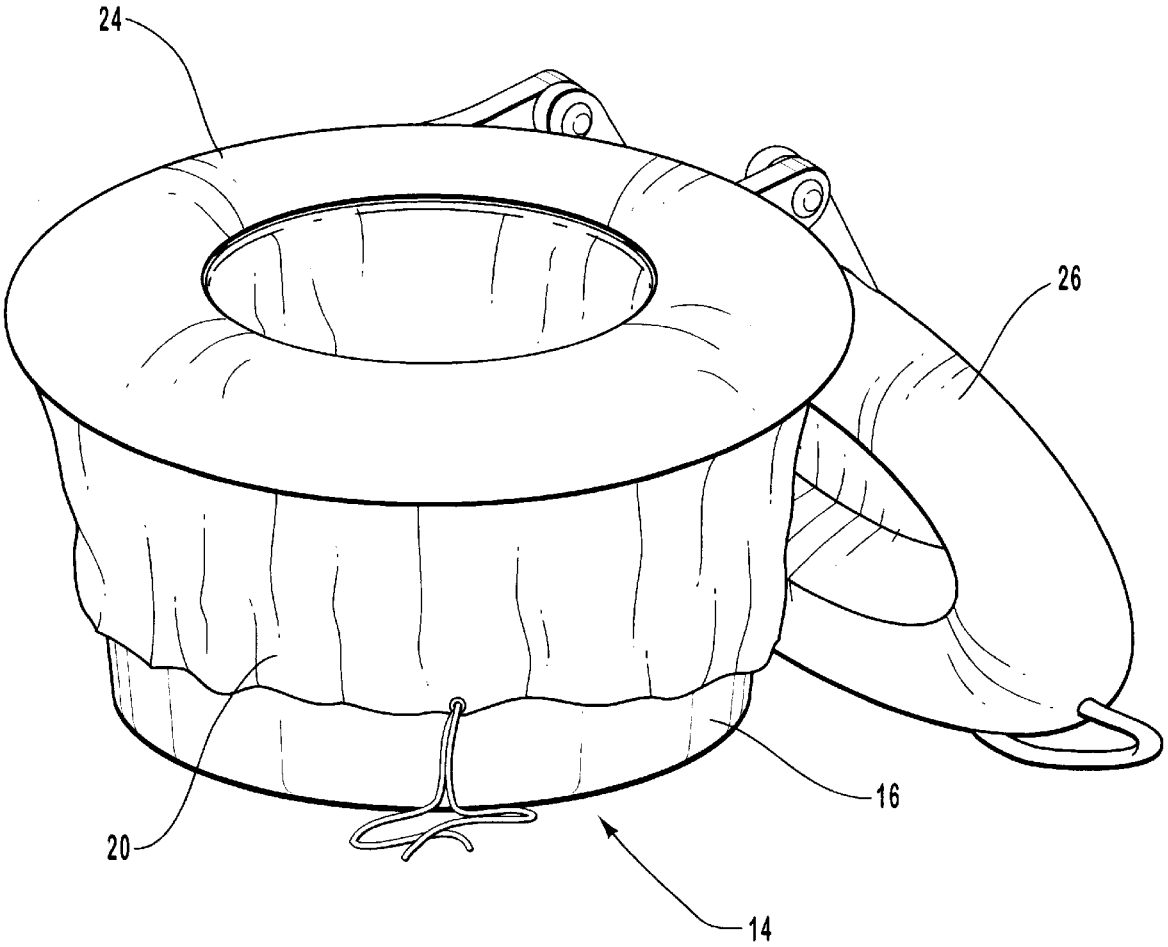
FIG. 1 is a perspective view of an apparatus for collecting human waste.

The apparatus for initially containing the human waste is shown in FIG. 1 having a cylindrical receiving chamber 14 having sides 16 and a bottom not shown forming an open topped cylinder. Into the cylinder is placed a flexible liner 20 having a draw string 22. It would be appreciated by those skilled in the art that many methods can be utilized for closing flexible liner 20. Means for closing flexible liner 20 include velcro type system, knots, tape, and also include an inner flap to assist in sealing the liner after use. A seat 24 is hingedly attached to side 16 of cylindrical receiving chamber 14. Also hingedly attached is a cover 26 which is so sized in shape as to complement seat 24 so as to seal the opening in the top of cylindrical receiving chamber 14. Although not illustrated in FIG. 1, means for locking cover 26 into a closed position may also be provided.

Figure 2:
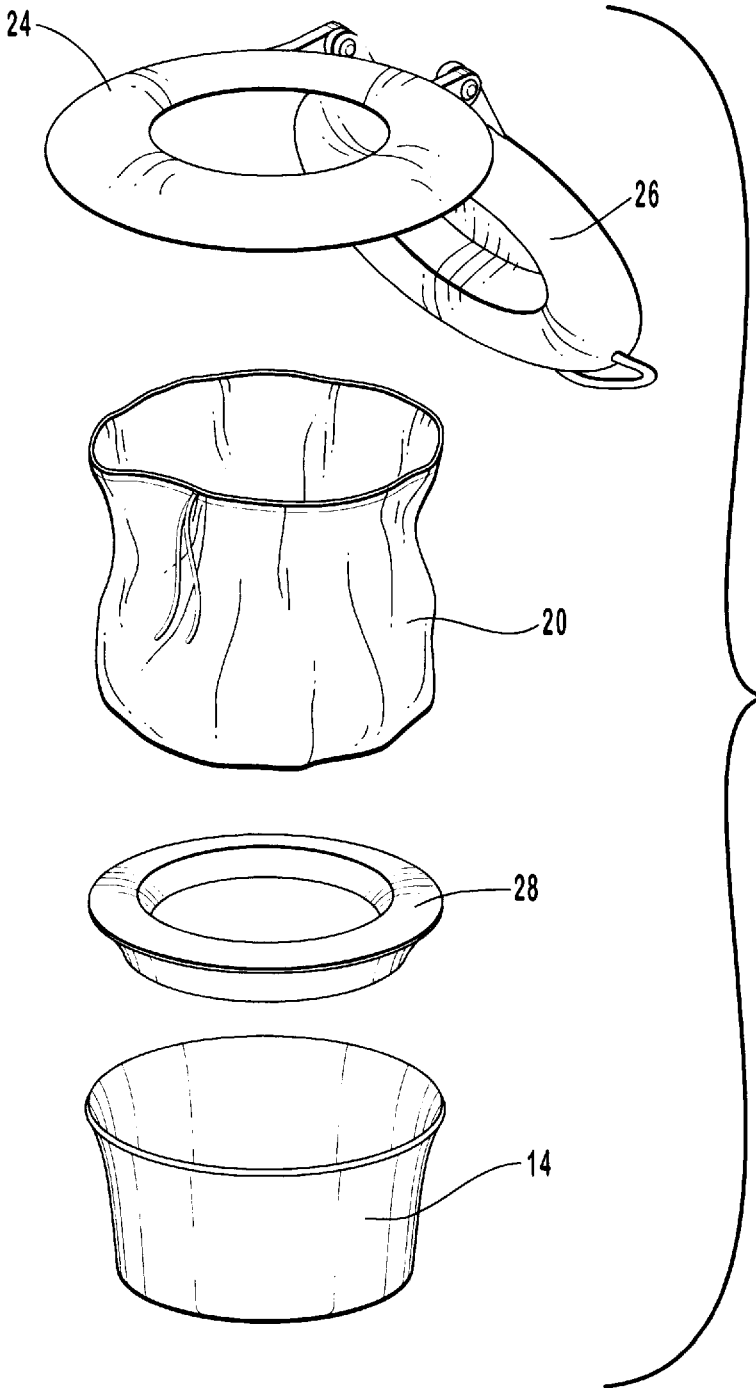
FIG. 2 is a disassembled view of the apparatus shown in FIG. 1.

As can best be seen in FIG. 2, a support ring 28 is interposed between seat 24 and cylindrical receiving chamber 14 to hold flexible liner 20 in place. In use, flexible liner 20 is placed within cylindrical chamber 14 over support ring 28 and seat 24 is then swung up into place for use. If the unit is not in use, cover 26 can be utilized to prevent odors from escaping from the chamber and to prevent spillage if the unit is operated in a marine environment or when the unit is being transported.

Figure 3:
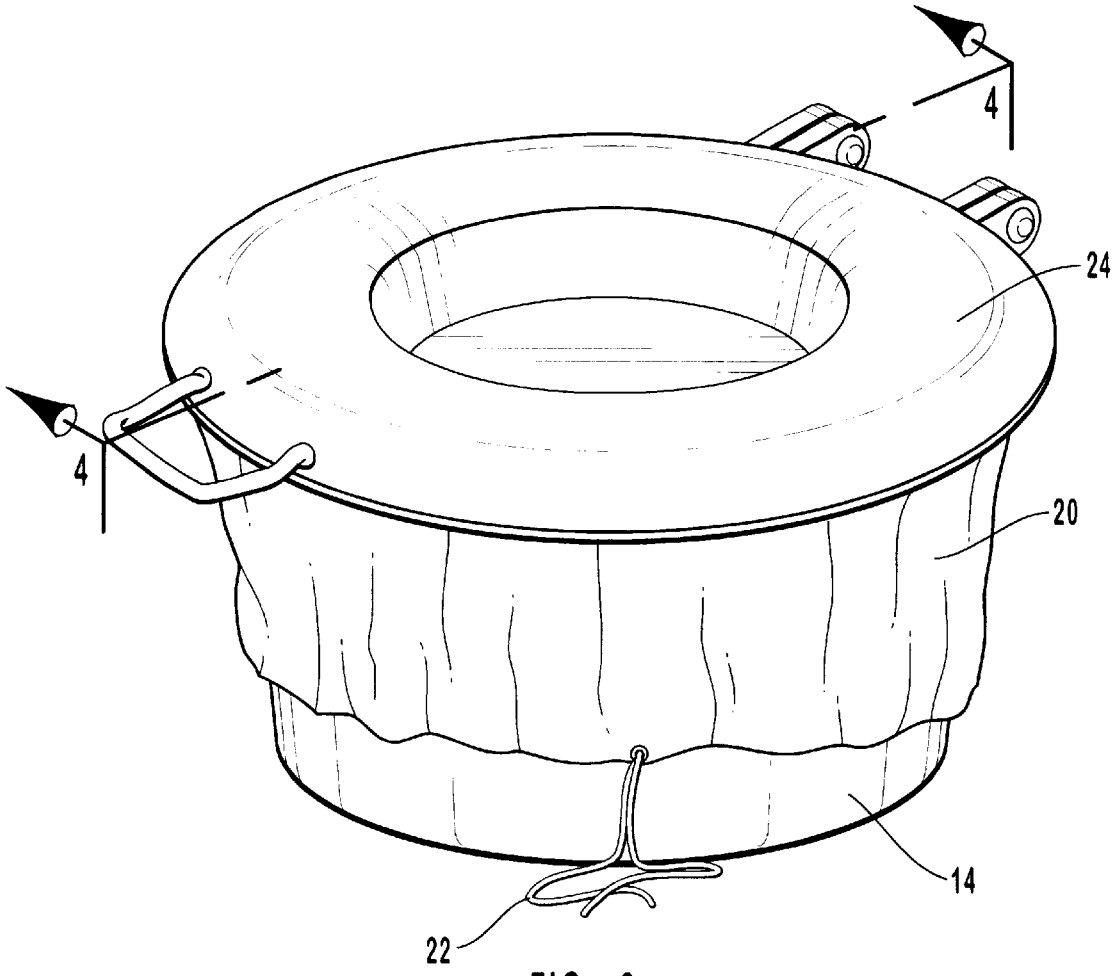
FIG. 3 is a perspective view of the apparatus shown in FIG. 1 in a closed position.
Figure 4:
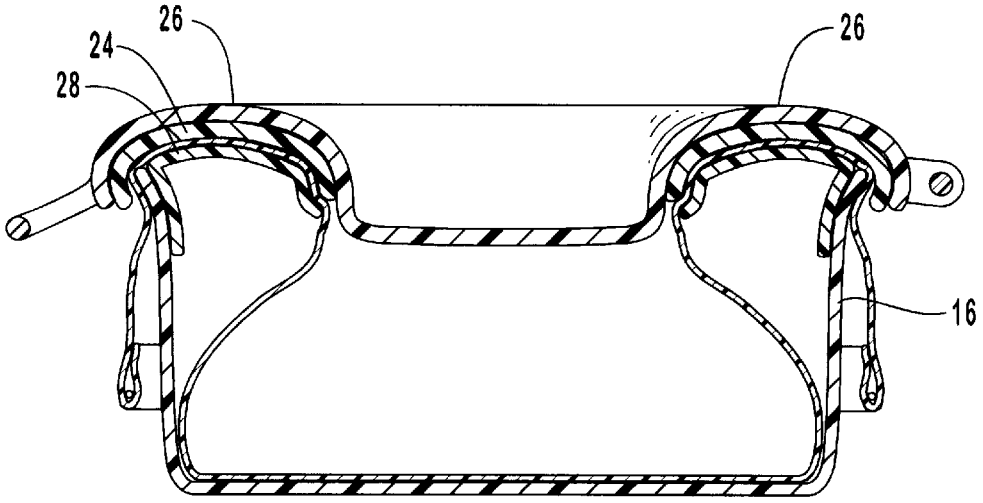
FIG. 4 is a cross-sectional side view of the apparatus shown in FIG. 3.

FIGS. 3 and 4 demonstrate the arrangement of the aforementioned structures in a typical embodiment.

Figure 5:
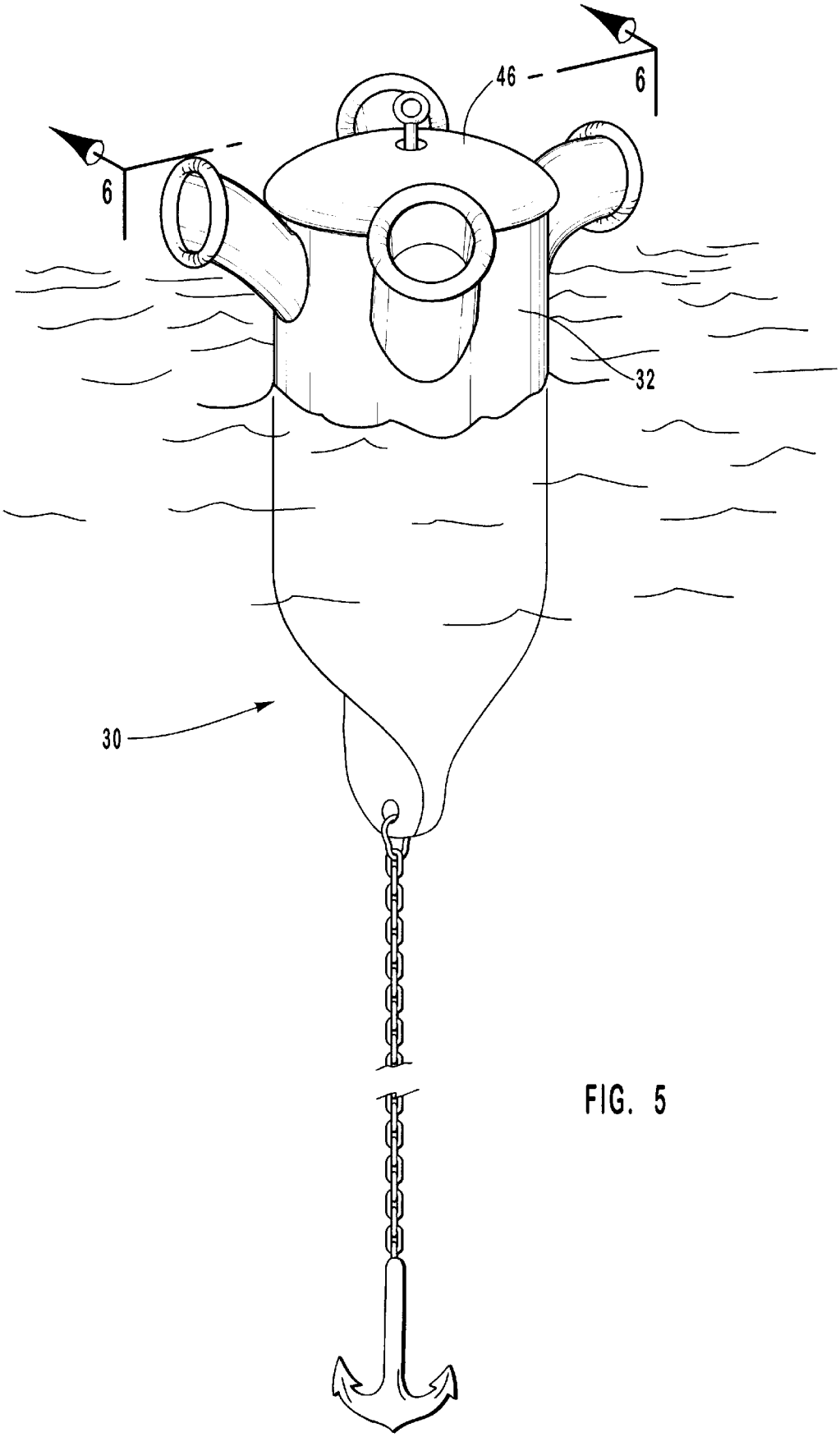
FIG. 5 is a perspective view of a floating receiving station for human waste.
Figure 6:
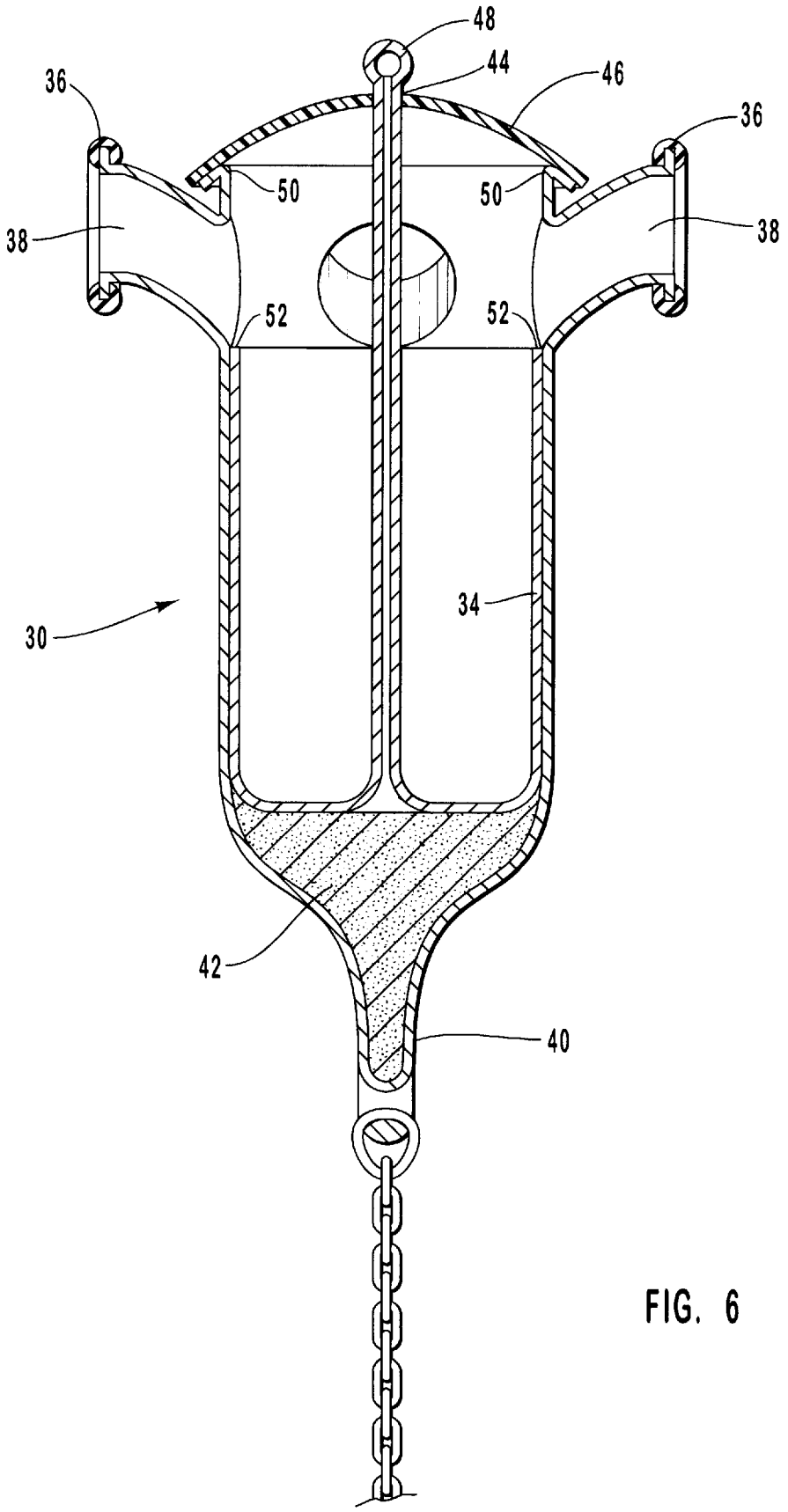
FIG. 6 is a cross-sectional side view of the apparatus shown in FIG. 5.
Figure 7:
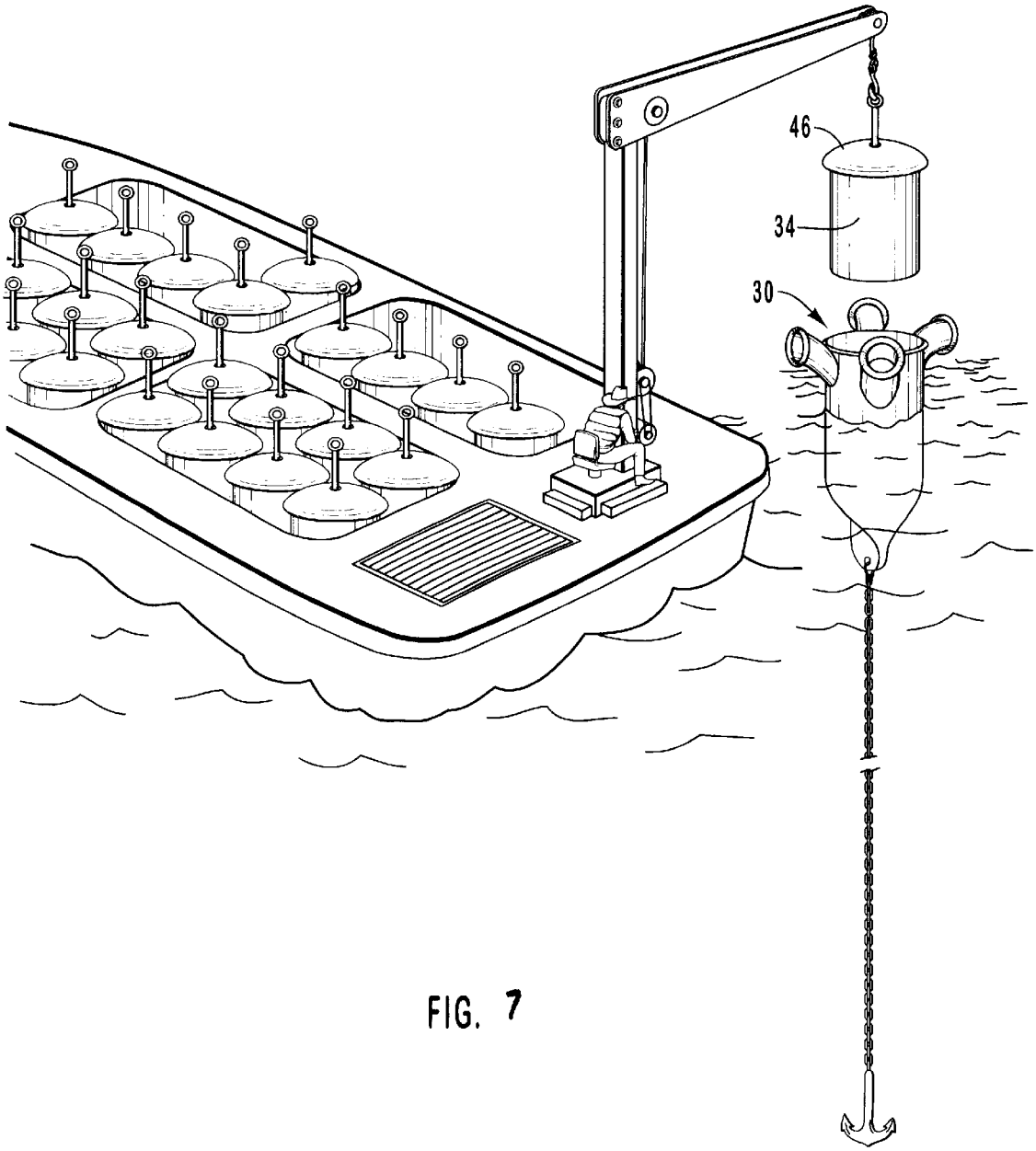
FIG. 7 is a perspective view of a collecting system for interacting with the apparatus shown in FIG. 5.

Turning now to FIG. 5, another apparatus used in the waste gathering and disposal system is a floating receiving station for the deposit of the flexible layers discussed previously and other human waste containers. The receiving station 30 in the embodiment illustrated in FIG. 5 is created of a durable and resilient plastic. When FIGS. 5 and 6 are viewed together it can be seen that an outer support shell 32 capable of containing an inner receiving vessel 34. Projecting outwardly from outer support shell 32 are receiving apertures 36. Receiving apertures 36 have openings 36 sized so as to be capable of receiving flexible liners 20 when filled with waste. Outer support shell 32 is anchored to the bottom of the body of water through known methods. As can be seen in FIG. 7, receiving station 30 is designed so that inner receiving vessel 34 may be removed therefrom by the use of a crane. The benefit of this system is that empty inner receiving vessels 34 may be placed within outer support shell 32 and left for a period of time during which users can pull along side receiving station 30 with their boats and dispose of waste held in flexible liners 20. The barge may then return after a period of time and remove the full inner receiving vessel 34 and replace it with an empty vessel. As can be seen most clearly in FIG. 6, outer receiving vessel 34 is formed so as to have a keel 40 and is ballasted by providing an amount of ballasted 42 in the lower end of the shell. An air passageway 44 is formed through the center of inner receiving vessel 34 so as to break the suction between inner receiving vessel 34 and outer support shell 30 when the inner vessel is removed from outer support shell 32.

It is important to note that a lid 46 is not fixedly attached to a massed 48 but instead slides along massed 48 and rests on an upper lip 50 of outer support shell 32. When the inner receiving vessel is to be removed and placed on a transport vehicle for processing, a winch and crane are utilized to attach a hook to a ring located atop massed 48 so as to removed inner receiving vessel 34 from the outer support shell 32. When inner receiving vessel 34 is lifted by massed 48, lid 46 slides along massed 48 until encountering an upper edge 52 of inner receiving vessel 34. Lid 46 then seals the tops of inner receiving vessel 34 as the vessel is transported.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An apparatus for receiving containers of human waste, the apparatus comprising:

a. a floating receiving station;

b. a receiving aperture projecting from the receiving station, the receiving aperture being so sized and configured as to be capable of admitting containers of human waste;

c. an inner receiving vessel within the floating receiving station in communication with the receiving aperture capable of being removed from the receiving station; and d. attached to the inner receiving vessel, means for removing the vessel from the receiving station.

* * * * *